US005769969A

United States Patent [19]

Ishikawa et al.

[11] Patent Number: 5,769,969

[45] Date of Patent: Jun. 23, 1998

[54] RARE EARTH-IRON-NITROGEN MAGNET ALLOY

[75] Inventors: Takashi Ishikawa, Ichikawa; Atsushi Kawamoto, Inzai, both of Japan

[73] Assignee: Sumitomo Metal Mining Co., Ltd., Tokyo, Japan

[21] Appl. No.: 753,530

[22] Filed: Nov. 26, 1996

[30] Foreign Application Priority Data

Nov. 28, 1995 [JP] Japan ..... 7-308725

[51] Int. Cl.[6] ..... H01F 1/059

[52] U.S. Cl. ..... 148/301; 420/83; 420/435

[58] Field of Search ..... 148/301, 303; 420/83, 435

[56] References Cited

U.S. PATENT DOCUMENTS

| | | | |
|---|---|---|---|
| 4,767,450 | 8/1988 | Ishigaki et al. | 420/83 |
| 5,466,307 | 11/1995 | Tong et al. | 148/303 |
| 5,534,361 | 7/1996 | Hisano et al. | 148/301 |
| 5,591,535 | 1/1997 | Hisano et al. | 148/301 |

FOREIGN PATENT DOCUMENTS

| | | | |
|---|---|---|---|
| 0 453 270 | 10/1991 | European Pat. Off. | 148/301 |
| 0 599 647 | 1/1994 | European Pat. Off. | 148/301 |
| 3-16102 | 1/1991 | Japan | 148/301 |

*Primary Examiner*—John Sheehan

*Attorney, Agent, or Firm*—Watson Cole Grindle Watson, P.L.L.C.

[57] ABSTRACT

A rare earth-iron-nitrogen magnet alloy contains a rare earth element (at least one of the lanthanoids including Y), iron and nitrogen as its main components, or may further contain at least one of Ti, V, Cr, Mn, Cu, Zr, Nb, Mo, Hf, Ta, W, Al, Si and C as another main component M. The main phase of the alloy also contains 0.001 to 0.1% by weight of at least one of Li, Na, X, Rb, Cs, Mg, Ca, Sr and Ba.

15 Claims, No Drawings

RARE EARTH-IRON-NITROGEN MAGNET ALLOY

BACKGROUND OF THE INVENTION

1. Field of the Invention

This invention relates to a rare earth-iron-nitrogen magnet alloy for making a permanent magnet having excellent magnetic properties, and more particularly, to a rare earth-iron-nitrogen magnet alloy which can be manufactured at a low cost owing to a shortened nitriding time and thereby an improved productivity.

2. Description of the Prior Art

Attention has recently been directed to a rare earth-iron-nitrogen magnetic material obtained by introducing nitrogen into an intermetallic compound having a crystal structure belonging to the rhombohedral, or hexagonal or tetragonal, or monoclinic system, since it has excellent magnetic properties as a material for a permanent magnet.

Japanese Patent Application Laid-Open No. Sho 60-131949, for example, discloses a permanent magnet represented as Fe—R—N (in which R stands for one or more elements selected from the group consisting of Y, Th and all the lanthanoids). Japanese Patent Application Laid-Open No. Hei 2-57663 discloses a magnetically anisotropic material having a hexagonal or rhombohedral crystal structure and represented as R—Fe—N—H (in which R stands for at least one of the rare-earth elements including yttrium). Japanese Patent Application Laid-Open No. Hei 5-315114 discloses a process for manufacturing a rare-earth magnet material obtained by incorporating nitrogen in an intermetallic compound of the $ThMn_{12}$ type having a tetragonal crystal structure. Japanese Patent Application Laid-Open No. Hei 6-279915 discloses a rare-earth magnet material obtained by incorporating nitrogen, etc. in an intermetallic compound of the $Th_2Zn_{17}$, $TbCu_7$ or $ThMn_{12}$ type having a rhombohedral, or hexagonal or tetragonal crystal structure. A. Margarian, et al. disclose a material obtained by incorporating nitrogen in an intermetallic compound of the $R_3(Fe, Ti)_{29}$ type having a monoclinic crystal structure in Proc. 8th Int. Symposium on Magnetic Anisotropy and Coercivity in Rare Earth Transition Metal Alloys, Birmingham, (1994), 353. Sugiyama, et al. disclose an $Sm_3(Fe, Cr)_{29}N_7$ compound having a monoclinic crystal structure in Resume of the Scientific Lectures at the 19th Meeting of the Japanese Society of Applied Magnetics (1995), *Digest of the 19th Annual Conference on Magnetics in Japn*, p. 120.

The addition of various substances to these materials has been studied to improve their magnetic properties, etc. Japanese Patent Application Laid-Open No. Hei 3-16102, for example, discloses a magnetic material having a hexagonal or rhombohedral crystal structure and represented as R—Fe—N—H—M (in which R stands for at least one of the rare-earth elements including Y, M stands for at least one of the elements Li, Na, K, Mg, Ca, Sr, Ba, Ti, Zr, Hf, V, Nb, Ta, Cr, Mo, W, Mn, Pd, Cu, Ag, Zn, B, Al, Ga, In, C, Si, Ge, Sn, Pb and Bi, and the oxides, fluorides, carbides, nitrides, hydrides, carbonates, sulfates, silicates, chlorides and nitrates of those elements and R). Japanese Patent Application Laid-Open No. Hei 4-99848 discloses a permanent magnet material represented as Fe—R—M—N (R stands for any of Y, Th and all the lanthanoids, and M stands for any of Ti, Cr, V, Zr, Nb, Al, Mo, Mn, Hf, Ta, W, Mg and Si). Japanese Patent Application Laid-Open No. Hei 3-153852 discloses a magnetic material having a hexagonal or rhombohedral crystal structure and represented as R—Fe—N—H—O—M (in which R stands for at least one of the rare earth elements including Y, and M stands for at least one of the elements Mg, Ti, Zr, Cu, Zn, Al, Ga, In, Si, Ge, Sn, Pb and Bi, and the oxides, fluorides, carbides, nitrides and hydrides of those elements and R).

As a process for manufacturing these magnetic materials, there is a process which comprises preparing a rare earth-iron matrix alloy powder and nitriding it to introduce nitrogen atoms into it. As a process for preparing a matrix alloy powder, there is, for example, a process which comprises mixing a rare earth metal, iron and any other metal, if necessary, in appropriate proportions, melting their mixture by a high frequency induction current in an inert gas atmosphere to form an alloy ingot, subjecting it to homogenizing heat treatment, and crushing it to an appropriate size by a jaw crusher, etc. According to another process, the same alloy ingot is used to make a thin alloy strip by rapid quenching, and it is crushed. There is also a process which relies upon reduction and diffusion for preparing an alloy powder from a rare earth oxide powder, a reducing agent, an iron powder and another metal powder, if necessary.

For nitriding, there is, for example, a method which comprises heating the matrix alloy powder to a temperature of 200° C. to 700° C. in a gas atmosphere composed of nitrogen or ammonia, or a mixture thereof with hydrogen.

A considerably long time is, however, required for introducing a sufficiently large amount of nitrogen atoms into an intermetallic compound by nitriding. Low productivity resulting in a high manufacturing cost has, therefore, been a problem presented by the conventional processes. Attempts have been made to employ a higher temperature for accelerating the nitriding reaction, but have been of little effect, since it causes the decomposition of the compound which has been obtained. Attempts have also been made to employ a nitriding atmosphere having a high pressure, but have raised a problem as to safety.

SUMMARY OF THE INVENTION

Under these circumstances, it is an object of this invention to provide a rare earth-iron-nitrogen magnet alloy which can be manufactured at a low cost owing to a shortened nitriding time, enabling an improved productivity.

As a result of our efforts to make an invention which can attain the above object, we, the inventors have found that a reaction for forming nitrogen atoms on the surface of a rare earth-iron magnet alloy is a rate-determining step in its nitriding reaction in a nitrogen atmosphere, or a nitrogen-containing atmosphere formed by ammonia, or the like, and that the rate of the nitrogen atom forming reaction and hence that of the nitriding reaction of the alloy can be increased if a highly electron-donative alkali, or alkaline earth metal, such as Li, Na, K, Rb, Cs, Mg, Ca, Sr or Ba, is added to the phase of an intermetallic compound in the alloy.

According to one aspect of this invention, the above object is attained by a rare earth-iron-nitrogen magnet alloy which consists mainly of a rare earth element (at least one of the lanthanoids including Y), iron and nitrogen, and contains 0.001 to 0.1% by weight of at least one element selected from the group consisting of Li, Na, K, Rb, Cs, Mg, Ca, Sr and Ba.

According to another aspect of this invention, the above object is attained by a rare earth-iron-nitrogen magnet alloy which consists mainly of a rare earth element (at least one of the lanthanoids including Y), iron, nitrogen and M (M stands for at least one element selected from the group consisting of Ti, V, Cr, Mn, Cu, Zr, Nb, Mo, Hf, Ta, W, Al, Si and C), and contains 0.001 to 0.1% by weight of at least one element selected from the group consisting of Li, Na, K, Rb, Cs, Mg, Ca, Sr and Ba.

DETAILED DESCRIPTION OF THE INVENTION

The alloy of this invention is preferably an alloy having a rhombohedral, or hexagonal, or tetragonal, or monoclinic crystal structure so as to exhibit excellent magnetic properties.

It is preferable for the alloy to contain as the rare earth element (or at least one of the lanthanoids including Y) at least one of Y, La, Ce, Pr, Nd and Sm, or both at least one of them and at least one of Eu, Gd, Tb, Dy, Ho, Er, Tm and Yb so as to exhibit high magnetic properties. An alloy containing Pr, Nd or Sm exhibits particularly high magnetic properties. It is preferable for its magnetic properties that the alloy contain 14 to 26% by weight of rare earth element or elements.

The alloy may have a part of its iron replaced by one or both of Co and Ni in order to have its temperature characteristics and corrosion resistance improved without having its magnetic properties lowered.

The alloy contains at least 1% by weight of nitrogen. Less nitrogen results in a magnet having low magnetic properties.

The alloy has a stabilized crystal structure and thereby improved magnetic properties if it contains as M at least one of Ti, V, Cr, Mn, Cu, Zr, Nb, Mo, Hf, Ta, W, Al, Si and C. Its content is, however, preferably not more than 12% by weight, since there would otherwise occur a lowering in the magnetic properties of the alloy, particularly its saturation magnetization.

Examples of the intermetallic compounds having a rhombohedral, or hexagonal, or tetragonal, or monoclinic crystal structure are an $Sm_2Fe_{17}N_3$ alloy of the $Th_2Zn_{17}$ type, an (Sm, Zr)(Fe, Co)10Nx alloy of the TbCu7 type, an NdFe11TiNx alloy of the $ThMn_{12}$ type, an $Sm_3(Fe, Ti)_{29}N_5$ alloy of the $R_3(Fe, Ti)_{29}$ type and an $Sm_3(Fe, Cr)_{29}Nx$ alloy.

The amount of at least one of Li, Na, K, Rb, Cs, Mg, Ca, Sr and Ba which the alloy contains has to be from 0.001 to 0.1% by weight. Less than 0.001% by weight is too little for any shortening of the nitriding time, and over 0.1% by weight brings about an undesirable lowering in the magnetic properties of the alloy, particularly its magnetization.

According to this invention, it is essential to have any such alkali, or alkaline earth metal introduced in the phase of an intermetallic compound having a rhombohedral, or hexagonal, or tetragonal, or monoclinic crystal structure. No effect can be expected at all from Ca, or any other alkali, or alkaline earth metal in the form in which it exists in any alloy formed by reduction-diffusion method as disclosed in Japanese Patent Application Laid-Open No. Sho 61-295308, Hei 5-148517, Hei 5-271852, Hei 5-279714 or Hei 7-166203, i.e. if any alkali, or alkaline earth metal, or any oxide thereof remains around or among the particles of an alloy powder without being fully removed by wet treatment following the reduction-diffusion method reaction.

According to Japanese Patent Application Laid-Open No. Hei 3-16102 as referred to before, at least one of the elements Li, Na, K, Mg, Ca, Sr, Ba, Ti, Zr, Hf, V, Nb, Ta, Cr, Mo, W, Mn, Pd, Cu, Ag, Zn, B, Al, Ga, In, C, Si, Ge, Sn, Pb and Bi, and the oxides, fluorides, carbides, nitrides, hydrides, carbonates, sulfates, silicates, chlorides and nitrates of those elements and R, which is added as M in the magnetic material represented as R—Fe—N—H—M, can most effectively be added after the formation of the R—Fe—N—H compound formed by nitriding the matrix alloy powder and before the subsequent sintering step. Therefore, the invention which it discloses has nothing to do with the shortening of nitriding time according to this invention. The Japanese application states that it is also possible to add M when the matrix alloy is manufactured, but that it is necessary to form as two separate phases a phase containing a large amount of M in the boundary of particles in the alloy powder and a phase not containing M in the center of the alloy particles. This invention, however, makes it necessary for M to be uniformly present in the alloy particles, and has, therefore, nothing to do with the invention disclosed in the Japanese application.

There is no particular limitation to the process to be employed for manufacturing the alloy of this invention, but it can be manufactured if a rare earth-iron matrix alloy powder is prepared by a conventional method, such as melt casting, rapid quenching or reduction-diffusion method, and is nitrided. The process in which the matrix alloy is made by reduction-diffusion method has an economical advantage over any other process, since it employs an inexpensive rare earth oxide as a raw material, since the alloy can be made in powder form, and does, therefore, not require any rough crushing step, and since the alloy contains so small an amount of residual iron affecting its magnetic properties adversely that no homogenizing heat treatment thereof is required. If the element to be introduced is Li, Na, K, Mg, Ca, Sr or Ba, the reducing agent itself can be used as a source of supply of any such element, since the same metal, or a hydride thereof is used as the reducing agent. Any such element can be introduced quantitatively into the phase of an intermetallic compound if careful control is made of the amount in which it is used as the reducing agent, the nature as a powder of the reducing agent and rare earth oxide, the nature of a mixture of the powders of the raw materials and the temperature and time employed for the reduction-diffusion method reaction. Metallic calcium is preferred as the reducing agent from the standpoints of safety in handling and cost.

The analysis of Li, Na, K, Rb, Cs, Mg, Ca, Sr or Ba incorporated in the alloy can be made by, for example, embedding the alloy in a resin, polishing its surface and employing EPMA for its quantitative analysis. The analysis can alternatively be made by preparing a working curve and employing SIMS. If the matrix alloy is produced by reduction-diffusion method employing Li, Na, K, Mg, Ca, Sr or Ba as the reducing agent, no ordinary chemical analysis can be recommended, since the reducing agent is difficult to distinguish from the metal remaining around or among the particles of the alloy powder.

The hydrogenation of the rare earth-iron alloy prior to its nitriding enables its nitriding at a still higher rate.

The invention will now be described more specifically by way of examples in which it is embodied.

EXAMPLE 1

Samples 1 to 3

A twin-cylinder mixer was used to mix 2.25 kg of an electrolytic iron powder having a purity of 99.9% by weight and a grain size not exceeding 150 mesh (as measured by a Tyler standard sieve), 1.01 kg of a samarium oxide powder having a purity of 99% by weight and an average grain size of 325 mesh (as measured by a Tyler standard sieve), 0.44 kg of granular metallic calcium having a purity of 99% by weight and 0.05 kg of anhydrous calcium chloride. The mixture was placed in a stainless steel vessel, and heated at a temperature of 1150° C. to 1180° C. for 8 to 10 hours in an argon gas atmosphere to undergo a reduction-diffusion method reaction. The reaction product was cooled, and thrown into water for disintegration. There were several tens of grams of 48-mesh or larger particles, and as they were slow in reacting with water, they were crushed in a ball mill so as to have their reaction with water promoted for accelerated disintegration.

The resulting slurry was washed with water, and with acetic acid until it had a pH of 5.0, whereby the unreacted calcium and CaO formed as a by-product were removed. After filtration and ethanol purging, the slurry was dried in a vacuum to yield about 3 kg of a matrix Sm—Fe alloy powder having a particle size not exceeding 100 microns as each sample. The powder was placed in a tubular furnace, and was heated at 465° C. for six hours in a mixed ammonia-hydrogen gas atmosphere having an ammonia partial pressure of 0.35 (for nitriding), and then at 465° C. for two hours in an argon gas atmosphere (for annealing) to yield an Sm—Fe—N magnet alloy powder. The analysis of the alloy powder by X-ray diffraction revealed only the diffraction patterns indicating a rhombohedral crystal structure of the $Th_2Zn_{17}$ type (an intermetallic compound $Sm_2Fe_{17}N_3$).

Then, the alloy powder was embedded in a polyester resin, and after polishing with emery paper and a buff, quantitative analysis was made of calcium in each of 10 random samples of the powder of intermetallic compound $Sm_2Fe_{17}N_3$ by employing an EPMA apparatus of Shimadzu Seisakusho (EPMA-2300 having a beam diameter of about one micron). An acceleration voltage of 20 kV, a sample current of $1\times10^{-7}$ A and an integrating time of 60 seconds were employed for realizing a high sensitivity of detection. Then, the alloy powder was finely crushed to a Fischer average particle diameter of 1.7 microns by a vibratory ball mill and its magnetic properties were determined by a vibrating sample magnetometer with a maximum magnetic field of 15 kOe. The fine powder and paraffin wax were packed in a sample case, and after the wax was melted by a dryer, a magnetic field having a strength of 20 kOe was applied to the powder to orient its axis of easy magnetization, and its pulsed magnetization was made in a magnetic field having a strength of 70 kOe. Evaluation was made by considering the phase of the intermetallic compound $Sm_2Fe_{17}N_3$ as having a true density of 7.67 g/cc and without any caribration of demagnetizing field. Table 1 shows the reaction temperature and time employed for reduction-diffusion method, the values of Sm, Fe and N as determined by chemical analysis, the value of Ca as determined by EPMA and the magnetic properties of the alloy.

TABLE 1

| | |
|---|---|
| Sample 1 | |
| Conditions for reduction-diffusion method: | Temperature - 1180° C.<br>Time - 10 hours |
| Composition of the alloy: | Sm - 23.8% by weight<br>Fe - 72.0% by weight<br>N - 3.3% by weight<br>Ca - 0.08% by weight |
| Magnetic properties: | Br - 13.9 kG<br>HcJ - 7.8 kOe<br>$(BH)_{max}$ - 30.2 MGOe |
| Sample 2 | |
| Conditions for reduction-diffusion method: | Temperature - 1180° C.<br>Time - 8 hours |
| Composition of the alloy: | Sm - 23.8% by weight<br>Fe - 72.5% by weight<br>N - 3.4% by weight<br>Ca - 0.009% by weight |
| Magnetic properties: | Br - 14.2 kG<br>HcJ - 8.1 kOe<br>$(BH)_{max}$ - 31.8 MGOe |
| Sample 3 | |
| Conditions for reduction-diffusion method: | Temperature - 1150° C.<br>Time - 8 hours |
| Composition of the alloy: | Sm - 23.8% by weight<br>Fe - 72.4% by weight<br>N - 3.4% by weight<br>Ca - 0.001% by weight |
| Magnetic properties: | Br - 13.9 kG<br>HcJ - 8.7 kOe<br>$(BH)_{max}$ - 31.1 MGOe |

Comparative Example 1

Samples 4 to 6

Sm—Fe—N magnet alloy powders were made by employing a temperature of 1000° C. or 1200° C. and a time of 6 or 12 hours for the reduction-diffusion method reaction and a nitriding time of 6 or 12 hours, and otherwise repeating Example 1. Table 2 shows the temperature and time employed for the reductive diffusion reaction, the nitriding time, the values of Sm, Fe and N as determined by chemical analysis, the value of Ca as determined by EPMA and the magnetic properties. The analysis of Sample 4 by X-ray diffraction revealed the diffraction pattern indicating an unnitrided phase. It is obvious from Samples 4 and 5 that an alloy containing less than 0.001% by weight of calcium requires a long nitriding time for obtaining satisfactory magnetic properties, while it is obvious from Sample 6 that an alloy containing over 0.1% by weight of calcium has a low level of Br.

TABLE 2

| | |
|---|---|
| Sample 4 | |
| Conditions for reduction-diffusion method: | Temperature - 1000° C.<br>Time - 6 hours |
| Nitriding time: 6 hours | |
| Composition of the alloy: | Sm - 23.9% by weight<br>Fe - 72.6% by weight<br>N - 2.4% by weight<br>Ca - <0.001% by weight |
| Magnetic properties: | Br - 11.1 kG<br>HcJ - 6.5 kOe<br>$(BH)_{max}$ - 15.2 MGOe |
| Sample 5 | |
| Conditions for reduction-diffusion method: | Temperature - 1000° C.<br>Time - 6 hours |
| Nitriding time: 12 hours | |
| Composition of the alloy: | Sm - 23.8% by weight<br>Fe - 72.4% by weight<br>N - 3.4% by weight<br>Ca - <0.001% by weight |
| Magnetic properties: | Br - 14.0 kG<br>HcJ - 8.1 kOe<br>$(BH)_{max}$ - 30.2 MGOe |
| Sample 6 | |
| Conditions for reduction-diffusion method: | Temperature - 1200° C.<br>Time - 12 hours |
| Nitriding time: 6 hours | |

TABLE 2-continued

| | |
|---|---|
| Composition of the alloy: | Sm - 23.3% by weight<br>Fe - 72.0% by weight<br>N - 3.4% by weight<br>Ca - 0.20% by weight |
| Magnetic properties: | Br - 12.6 kG<br>HcJ - 9.1 kOe<br>$(BH)_{max}$ - 26.9 MGOe |

EXAMPLE 3

Samples 7 to 14

An alloy ingot weighing about 2 kg was made as each sample by taking appropriate amounts of electrolytic iron having a purity of 99.9% by weight, metallic samarium having a purity of 99.7% by weight and metallic Li, Na, K, Rb, Cs, Mg, Sr or Ba having a purity of 99% by weight or above, melting their mixture in a high-frequency melting furnace having an argon gas atmosphere, and casting the molten mixture into a steel mold having a width of 20 mm. The alloy ingot was held at 1100° C. for 48 hours in a high-purity argon gas atmosphere for homogenizing treatment. Then, it was crushed into a powder having a particle size not exceeding 100 microns by a jaw crusher and a ball mill. The powder was placed in a tubular furnace, and was heated at 465° C. for six hours in a mixed ammonia-hydrogen gas atmosphere having an ammonia partial pressure of 0.35 (for nitriding), and then at 465° C. for two hours in an argon gas atmosphere (for annealing) to yield an Sm—Fe—N magnet alloy powder. The analysis of the alloy powder by X-ray diffraction revealed only the diffraction patterns indicating a rhombohedral crystal structure of the $Th_2Zn_{17}$ type (an intermetallic compound $Sm_2Fe_{17}N_3$). Example 1 was repeated for evaluation. Table 3 shows the values of Sm, Fe and N as determined by chemical analysis, the value of the added element as determined by EPMA and the magnetic properties.

TABLE 3

| | |
|---|---|
| Sample 7 | |
| Composition of the alloy: | Sm - 24.4% by weight<br>Fe - 71.6% by weight<br>N - 3.5% by weight<br>Li - 0.001% by weight |
| Magnetic properties: | Br - 12.9 kG<br>HcJ - 10.1 kOe<br>$(BH)_{max}$ - 30.1 MGOe |
| Sample 8 | |
| Composition of the alloy: | Sm - 24.4% by weight<br>Fe - 71.5% by weight<br>N - 3.5% by weight<br>Na - 0.002% by weight |
| Magnetic properties: | Br - 13.2 kG<br>HcJ - 10.7 kOe<br>$(BH)_{max}$ - 30.0 MGOe |
| Sample 9 | |
| Composition of the alloy: | Sm - 24.5% by weight<br>Fe - 71.5% by weight<br>N - 3.5% by weight<br>K - 0.005% by weight |
| Magnetic properties: | Br - 12.8 kG<br>HcJ - 10.6 kOe<br>$(BH)_{max}$ - 30.1 MGOe |
| Sample 10 | |
| Composition of the alloy: | Sm - 24.4% by weight<br>Fe - 71.5% by weight<br>N - 3.5% by weight<br>Rb - 0.011% by weight |
| Magnetic properties: | Br - 12.9 kG<br>HcJ - 10.5 kOe<br>$(BH)_{max}$ - 30.1 MGOe |
| Sample 11 | |
| Composition of the alloy: | Sm - 24.4% by weight<br>Fe - 71.6% by weight<br>N - 3.4% by weight<br>Cs - 0.014% by weight |
| Magnetic properties: | Br - 13.0 kG<br>HcJ - 9.7 kOe<br>$(BH)_{max}$ - 29.9 MGOe |
| Sample 12 | |
| Composition of the alloy: | Sm - 24.6% by weight<br>Fe - 71.5% by weight<br>N - 3.5% by weight<br>Mg - 0.002% by weight |
| Magnetic properties: | Br - 12.8 kG<br>HcJ - 10.6 kOe<br>$(BH)_{max}$ - 30.1 MGOe |
| Sample 13 | |
| Composition of the alloy: | Sm - 24.4% by weight<br>Fe - 71.5% by weight<br>N - 3.4% by weight<br>Sr - 0.009% by weight |
| Magnetic properties: | Br - 13.1 kG<br>HcJ - 10.8 kOe<br>$(BH)_{max}$ - 30.8 MGOe |
| Sample 14 | |
| Composition of the alloy: | Sm - 24.7% by weight<br>Fe - 71.4% by weight<br>N - 3.5% by weight<br>Ba - 0.012% by weight |
| Magnetic properties: | Br - 12.7 kG<br>HcJ - 10.3 kOe<br>$(BH)_{max}$ - 29.7 MGOe |

Comparative Example 2

Samples 15 and 16

Sm—Fe—N magnet alloy powders were made without adding any of Li, Na, K, Rb, Cs, Mg, Sr and Ba, and by employing a nitriding time of 6 or 12 hours, and otherwise repeating Example 2. Table 4 shows the nitriding time, the values of Sm, Fe and N as determined by chemical analysis and the magnetic properties. The analysis of Sample 15 by X-ray diffraction revealed a diffraction pattern indicating an unnitrided phase. It is obvious from Samples 15 and 16 that an alloy not containing any element added to the alloy of this invention requires a long nitriding time for exhibiting satisfactory magnetic properties.

TABLE 4

| | |
|---|---|
| Sample 15 | |
| Nitriding time: 6 hours | |
| Composition of the alloy: | Sm - 24.6% by weight<br>Fe - 71.6% by weight<br>N - 2.8% by weight |
| Magnetic properties: | Br - 11.6 kG<br>HcJ - 6.1 kOe<br>$(BH)_{max}$ - 12.5 MGOe |
| Sample 16 | |
| Nitriding time: 12 hours | |

TABLE 4-continued

| | |
|---|---|
| Composition of the alloy: | Sm - 24.5% by weight<br>Fe - 71.5% by weight<br>N - 3.6% by weight |
| Magnetic properties: | Br - 13.0 kG<br>HcJ - 9.7 kOe<br>$(BH)_{max}$ - 29.9 MGOe |

Comparative Example 3

Samples 17 to 24

Sm—Fe—N magnet alloy powders were made by employing different amounts of Li, Na, K, Rb, Cs, Mg, Sr and Ba, and otherwise repeating Example 2. Table 5 shows the values of Sm, Fe and N as determined by chemical analysis, the value of the added element as determined by EPMA and the magnetic properties. The results teach that an alloy containing over 0.1% by weight of any such element has a low level of Br.

TABLE 5

| | |
|---|---|
| Sample 17 | |
| Composition of the alloy: | Sm - 24.0% by weight<br>Fe - 71.1% by weight<br>N - 3.2% by weight<br>Li - 0.11% by weight |
| Magnetic properties: | Br - 12.1 kG<br>HcJ - 9.7 kOe<br>$(BH)_{max}$ - 23.9 MGOe |
| Sample 18 | |
| Composition of the alloy: | Sm - 24.1% by weight<br>Fe - 71.1% by weight<br>N - 3.2% by weight<br>Na - 0.12% by weight |
| Magnetic properties: | Br - 12.2 kG<br>HcJ - 9.2 kOe<br>$(BH)_{max}$ - 25.1 MGOe |
| Sample 19 | |
| Composition of the alloy: | Sm - 24.1% by weight<br>Fe - 71.0% by weight<br>N - 3.3% by weight<br>K - 0.11% by weight |
| Magnetic properties: | Br - 12.2 kG<br>HcJ - 9.9 kOe<br>$(BH)_{max}$ - 27.1 MGOe |
| Sample 20 | |
| Composition of the alloy: | Sm - 24.1% by weight<br>Fe - 71.1% by weight<br>N - 3.2% by weight<br>Rb - 0.11% by weight |
| Magnetic properties: | Br - 12.6 kG<br>HcJ - 8.1 kOe<br>$(BH)_{max}$ - 27.3 MGOe |
| Sample 21 | |
| Composition of the alloy: | Sm - 24.0% by weight<br>Fe - 71.0% by weight<br>N - 3.3% by weight<br>Cs - 0.12% by weight |
| Magnetic properties: | Br - 12.7 kG<br>HcJ - 8.8 kOe<br>$(BH)_{max}$ - 27.6 MGOe |
| Sample 22 | |
| Composition of the alloy: | Sm - 24.3% by weight<br>Fe - 71.2% by weight<br>N - 3.2% by weight<br>Mg - 0.13% by weight |
| Magnetic properties: | Br - 12.3 kG<br>HcJ - 10.0 kOe<br>$(BH)_{max}$ - 25.4 MGOe |
| Sample 23 | |
| Composition of the alloy: | Sm - 24.1% by weight<br>Fe - 71.1% by weight<br>N - 3.1% by weight<br>Sr - 0.11% by weight |
| Magnetic properties: | Br - 11.9 kG<br>HcJ - 10.3 kOe<br>$(BH)_{max}$ - 24.4 MGOe |
| Sample 24 | |
| Composition of the alloy: | Sm - 24.2% by weight<br>Fe - 71.1% by weight<br>N - 3.2% by weight<br>Ba - 0.11% by weight |
| Magnetic properties: | Br - 12.2 kG<br>HcJ - 10.2 kOe<br>$(BH)_{max}$ - 25.0 MGOe |

EXAMPLE 3

Sample 25

An Sm—Fe—Co—Mn matrix alloy powder having a particle size not exceeding 100 microns was made by employing an electrolytic cobalt powder having a purity of 99.5% by weight and a grain size not exceeding 325 mesh and an electrolytic manganese powder having a purity of 99.7% by weight and a grain size not exceeding 300 mesh, and otherwise repeating Example 1. The powder was placed in a tubular furnace, and was heated at 465° C. for seven hours in a mixed ammonia-hydrogen gas atmosphere having an ammonia partial pressure of 0.37 (for nitriding), and then at 465° C. for two hours in an argon gas atmosphere (for annealing) to yield an Sm—Fe—N magnet alloy powder. The analysis of the alloy powder by X-ray diffraction revealed only the diffraction patterns indicating a rhombohedral crystal structure of the $Th_2Zn_{17}$ type (an intermetallic compound $Sm_2Fe_{17}N_3$). The powder was finely crushed to a Fischer average particle diameter of 22 microns for evaluation as to magnetic properties. Table 6 shows the reaction temperature and time employed for reduction-diffusion method, the values of Sm, Fe, Co, Mn and N as determined by chemical analysis, the value of Ca as determined by EPMA and the magnetic properties.

TABLE 6

| Sample 25 | |
|---|---|
| Conditions for reduction-diffusion method: | Temperature - 1180° C.<br>Time - 10 hours |
| Composition of the alloy: | Sm - 22.9% by weight<br>Fe - 60.5% by weight<br>Co - 8.2% by weight<br>Mn - 3.4% by weight<br>N - 4.6% by weight<br>Ca - 0.002% by weight |
| Magnetic properties: | Br - 10.6 kG<br>HcJ - 4.1 kOe<br>$(BH)_{max}$ - 18.1 MGOe |

Comparative Example 4

Samples 26 to 28

Sm—Fe—N magnet alloy powders were made by employing a temperature of 1000° C. or 1200° C. and a time of 6 or 12 hours for the reduction-diffusion method reaction and a nitriding time of 7 or 13 hours, and otherwise repeating Example 3. Table 7 shows the reaction temperature and time employed for the reduction-diffusion method, the nitriding time, the values of Sm, Fe, Co, Mn and N as determined by chemical analysis, the value of Ca as determined by EPMA and the magnetic properties. It is obvious from Samples 26 and 27 that an alloy containing less than 0.001% by weight of calcium calls for a long nitriding time for exhibiting satisfactory magnetic properties, while it is obvious from Sample 28 that an alloy containing over 0.1% by weight of calcium has a low level of Br.

TABLE 7

| | |
|---|---|
| Sample 26 | |
| Conditions for reduction-diffusion method: | Temperature - 1000° C.<br>Time - 6 hours |
| Nitriding time: 7 hours | |
| Composition of the alloy: | Sm - 23.0% by weight<br>Fe - 60.6% by weight<br>Co - 8.3% by weight<br>Mn - 3.4% by weight<br>N - 3.8.% by weight<br>Ca - <0.001% by weight |
| Magnetic properties: | Br - 11.1 kG<br>HcJ - 1.7 kOe<br>$(BH)_{max}$ - 2.8 MGOe |
| Sample 27 | |
| Conditions for reduction-diffusion method: | Temperature - 1000° C.<br>Time - 6 hours |
| Nitriding time: 13 hours | |
| Composition of the alloy: | Sm - 22.8% by weight<br>Fe - 60.5% by weight<br>Co - 8.2% by weight<br>Mn - 3.4% by weight<br>N - 4.7% by weight<br>Ca - <0.001% by weight |
| Magnetic properties: | Br - 10.5 kG<br>HcJ - 4.3 kOe<br>$(BH)_{max}$ - 18.0 MGOe |
| Sample 28 | |
| Conditions for reduction-diffusion method: | Temperature - 1200° C.<br>Time - 12 hours |
| Nitriding time: 7 hours | |
| Composition of the alloy: | Sm - 22.4% by weight<br>Fe - 60.2% by weight<br>Co - 8.1% by weight<br>Mn - 3.3% by weight<br>N - 4.6% by weight<br>Ca - 0.11% by weight |
| Magnetic properties: | Br - 10.1 kG<br>HcJ - 4.4 kOe<br>$(BH)_{max}$ - 15.2 MGOe |

EXAMPLE 4

Sample 29

An Nd—Fe—Ti matrix alloy powder weighing about 3 kg and, having a particle size not exceeding 100 microns was made by employing an electrolytic iron powder having a purity of 99.9% by weight and a grain size not exceeding 150 mesh, a ferrotitanium powder having a grain size not exceeding 200 mesh and a neodymium oxide powder having a purity of 99.9% by weight and an average grain size of 325 mesh, and otherwise repeating Example 1. The powder was placed in a tubular furnace, and was heated at 400° C. for six hours in a mixed ammonia-hydrogen gas atmosphere having an ammonia partial pressure of 0.35 (for nitriding), and then at 400° C. for an hour in an argon gas atmosphere (for annealing) to yield an Nd—Fe—Ti—N magnet alloy powder. The analysis of the powder by X-ray diffraction revealed only diffraction patterns indicating a tetragonal crystal structure of the $ThMn_{12}$ type (an intermetallic compound NdFe11TiN1). Table 8 shows the reaction temperature and time employed for the reduction-diffusion method, the values of Nd, Fe, Ti and N as determined by chemical analysis, the value of Ca as determined by EPMA and the magnetic properties.

TABLE 8

| Sample 29 | |
|---|---|
| Conditions for reduction-diffusion method: | Temperature - 1180° C.<br>Time - 10 hours |
| Composition of the alloy: | Nd - 17.4% by weight<br>Fe - 74.4% by weight<br>Ti - 5.7% by weight<br>N - 2.2% by weight<br>Ca - 0.003% by weight |
| Magnetic properties: | Br - 9.6 kG<br>HcJ - 4.7 kOe<br>$(BH)_{max}$ - 11.2 MGOe |

Comparative Example 5

Samples 30 to 32

Nd—Fe—Ti—N magnet alloy powders were made by employing a temperature of 1000° C. or 1200° C. and a time of 7 or 12 hours for the reduction-diffusion method reaction and a nitriding time of 6 or 12 hours, and otherwise repeating Example 4. Table 9 shows the reaction temperature and time employed for the reduction-diffusion method, the nitriding time, the values of Nd, Fe, Ti and N as determined by chemical analysis, the value of Ca as determined by EPMA and the magnetic properties. It is obvious from Samples 30 and 31 that an alloy containing less than 0.001% by weight of calcium requires a long nitriding time for exhibiting satisfactory magnetic properties, while it is obvious from Sample 32 that an alloy containing over 0.1% by weight of calcium has a low level of Br.

TABLE 9

| | |
|---|---|
| Sample 30 | |
| Conditions for reduction-diffusion method: | Temperature - 1000° C.<br>Time - 7 hours |
| Nitriding time: 6 hours | |
| Composition of the alloy: | Nd - 17.5% by weight<br>Fe - 74.6% by weight<br>Ti - 5.8% by weight<br>N - 1.7% by weight<br>Ca - <0.001% by weight |
| Magnetic properties: | Br - 7.3 kG<br>HcJ - 1.7 kOe<br>$(BH)_{max}$ - 1.9 MGOe |
| Sample 31 | |
| Conditions for reduction-diffusion method: | Temperature - 1000° C.<br>Time - 7 hours |
| Nitriding time: 12 hours | |
| Composition of the alloy: | Nd - 17.5% by weight<br>Fe - 74.3% by weight<br>Ti - 5.7% by weight<br>N - 2.3% by weight<br>Ca - <0.001% by weight |
| Magnetic properties: | Br - 9.5 kG<br>HcJ - 4.5 kOe<br>$(BH)_{max}$ - 10.9 MGOe |

TABLE 9-continued

| Sample 32 | |
|---|---|
| Conditions for reduction-diffusion method: | Temperature - 1200° C.<br>Time - 12 hours |
| Nitriding time: 6 hours | |
| Composition of the alloy: | Nd - 17.4% by weight<br>Fe - 74.4% by weight<br>Ti - 5.6% by weight<br>N - 2.2% by weight<br>Ca - 0.11% by weight |
| Magnetic properties: | Br - 8.3 kG<br>HcJ - 4.4 kOe<br>$(BH)_{max}$ - 9.7 MGOe |

An Sm—Fe matrix alloy powder weighing about 3 kg and having a particle size not exceeding 100 microns was made by employing an electrolytic iron powder having a purity of 99.9% by weight and a grain size not exceeding 150 mesh, a ferrochromium powder having a grain size not exceeding 200 mesh and a samarium oxide powder having a purity of 99% by weight and an average grain size of 325 mesh, and otherwise repeating Example 1. The powder was placed in a tubular furnace, and was heated at 500° C. for six hours in a mixed ammonia-hydrogen gas atmosphere having an ammonia partial pressure of 0.35 (for nitriding), and then at 500° C. for an hour in an argon gas atmosphere (for annealing) to yield an Sm—Fe—Cr—N magnet alloy powder. The analysis of the alloy powder by X-ray diffraction revealed only diffraction patterns indicating a monoclinic crystal structure of the $R_3(Fe, Ti)_{29}$ type. Table 10 shows the reaction temperature and time employed for the reduction-diffusion method, the values of Sm, Fe, Cr and N as determined by chemical analysis, the value of Ca as determined by EPMA and the magnetic properties.

TABLE 10

| Sample 33 | |
|---|---|
| Conditions for reduction-diffusion method: | Temperature - 1180° C.<br>Time - 10 hours |
| Composition of the alloy: | Sm - 21.2% by weight<br>Fe - 64.2% by weight<br>Cr - 10.5% by weight<br>N - 3.9% by weight<br>Ca - 0.002% by weight |
| Magnetic properties: | Br - 90 kG<br>HcJ - 6.5 kOe<br>$(BH)_{max}$ - 17.3 MGOe |

Comparative Example 6

Samples 34 to 36

Sm—Fe—Cr—N magnet alloy powders were made by employing a temperature of 1000° C. to 1200° C. and a time of 7 or 12 hours for the reduction-diffusion method reaction and a nitriding time of 6 or 12 hours, and otherwise repeating Example 5. Table 11 shows the reaction temperature and time employed for the reduction-diffusion method, the nitriding time, the values of Sm, Fe, Cr and N as determined by chemical analysis, the value of Ca as determined by EPMA and the magnetic properties. It is obvious from Samples 34 and 35 that an alloy containing less than 0.001% by weight of calcium requires a long nitriding time for exhibiting satisfactory magnetic properties, while it is obvious from Sample 36 that an alloy containing over 0.1% by weight of calcium has a low level of Br.

TABLE 11

| Sample 34 | |
|---|---|
| Conditions for reduction-duffusion method: | Temperature - 1000° C.<br>Time - 7 hours |
| Nitriding Time: 6 hours | |
| Composition of the alloy: | Sm - 21.4% by weight<br>Fe - 64.4% by weight<br>Cr - 10.6% by weight<br>N - 2.8% by weight<br>Ca - <0.001% by weight |
| Magnetic properties: | Br - 6.8 kG<br>HcJ - 3.2 kOe<br>$(BH)_{max}$ - 5.2 MGOe |
| **Sample 35** | |
| Conditions for reduction-diffusion method: | Temperature - 1000° C.<br>Time - 7 hours |
| Nitriding time: 12 hours | |
| Composition of the alloy: | Sm - 21.3% by weight<br>Fe - 64.3% by weight<br>Cr - 10.6% by weight<br>N - 3.8% by weight<br>Ca - <0.001% by weight |
| Magnetic properties: | Br - 8.8 kG<br>HcJ - 6.3 kOe<br>$(BH)_{max}$ - 16.8 MGOe |
| **Sample 36** | |
| Conditions for reduction-diffusion method: | Temperature - 1200° C.<br>Time - 12 hours |
| Nitriding time: 6 hours | |
| Composition of the alloy: | Sm - 20.7% by weight<br>Fe - 63.6% by weight<br>Cr - 10.1% by weight<br>N - 4.0% by weight<br>Ca - 0.11% by weight |
| Magnetic properties: | Br - 8.1 kG<br>HcJ - 6.4 kOe<br>$(BH)_{max}$ - 10.1 MGOe |

What is claimed is:

1. A rare earth-iron-nitrogen magnet alloy comprising mainly a rare earth element (at least one of the lanthanoids including Y), Iron and nitrogen, and also containing 0.001 to 0.1% by weight of at least one element selected from the group consisting of Li, K, Rb, Cs, Mg, Ca, Sr and Ba, said element being uniformly present in said alloy.

2. An alloy as set forth in claim 1, having a rhombohedral, hexagonal, tetragonal or monoclinic crystal structure.

3. An alloy as set forth in claim 1, wherein said rare earth element is at least one selected from the group consisting of Y, La, Ce, Pr, Nd and Sm, or is a combination of said at least one and at least one selected from the group consisting of Eu, Gd, Tb, Dy, Ho, Er, Tm and Yb.

4. An alloy as set forth in claim 1, containing said rare earth element in the amount of 14 to 26% by weight.

5. An alloy as set forth in claim 1, wherein a part of said iron is replaced by at least one selected from the group consisting of Ni and Co.

6. An alloy as set forth in claim 1, containing said nitrogen in the amount of at least 1% by weight.

7. An alloy as set forth in claim 1, wherein said at least one element selected from the group consisting of Li, Na, X, Rb, Cs, Mg, Ca, Sr and Ba is incorporated in an intermetallic compound having a rhombohedral, hexagonal, tetragonal or monoclinic crystal structure.

8. A rare earth-iron-nitrogen magnet alloy comprising mainly a rare earth element (at least one of the lanthanoids including Y), iron, nitrogen and M (M is at least one element selected from the group consisting of Ti, V, Cr, Mn, Cu, Zr, Nb, Mo, Hf, Ta, W, Al, Si and C) uniformly distributed therein, and also containing 0.001 to 0.1% by weight of at least one element selected from the group consisting of Li, Na, K, Rb, Cs, Mg, Ca, Sr and Ba.

9. An alloy as set forth in claim 8, having a rhombohedral, hexagonal, tetragonal or monoclinic crystal structure.

10. An alloy as set forth in claim 8, wherein said rare earth element is at least one selected from the group consisting of Y, La, Ce, Pr, Nd and Sm, or is a combination of said at least one and at least one selected from the group consisting of Eu, Gd, Tb, Dy, Ho, Er, Tm and Yb.

11. An alloy as set forth in claim 8, containing said rare earth element in the amount of 14 to 26% by weight.

12. An alloy as set forth in claim 8, wherein a part of said iron is replaced by at least one selected from the group consisting of Ni and Co.

13. An alloy as set forth in claim 8, containing said nitrogen in the amount of at least 1% by weight.

14. An alloy as set forth in claim 8, containing said M in the amount of 12% by weight or less.

15. An alloy as set forth in claim 8, wherein said at least one element selected from the group consisting of Li, Na, K, Rb, Cs, Mg, Ca, Sr and Ba is incorporated in an intermetallic compound having a rhombohedral, hexagonal, tetragonal or monoclinic crystal structure.

* * * * *